US010931017B2

(12) United States Patent
Sonoda et al.

(10) Patent No.: US 10,931,017 B2
(45) Date of Patent: Feb. 23, 2021

(54) ANTENNA

(71) Applicant: AGC Inc., Chiyoda-ku (JP)

(72) Inventors: Ryuta Sonoda, Chiyoda-ku (JP); Toshiki Sayama, Chiyoda-ku (JP); Koji Ikawa, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 16/157,539

(22) Filed: Oct. 11, 2018

(65) Prior Publication Data

US 2019/0044239 A1 Feb. 7, 2019

Related U.S. Application Data

(63) Continuation of application No. PCT/JP2017/015201, filed on Apr. 13, 2017.

(30) Foreign Application Priority Data

Apr. 15, 2016 (JP) ..... JP2016-081706

(51) Int. Cl.
*H01Q 9/04* (2006.01)
*H01Q 1/38* (2006.01)
(Continued)

(52) U.S. Cl.
CPC ..... *H01Q 9/0485* (2013.01); *H01Q 1/243* (2013.01); *H01Q 1/38* (2013.01); *H01Q 1/48* (2013.01);
(Continued)

(58) Field of Classification Search
CPC ..... H01Q 9/0485; H01Q 1/48; H01Q 1/38; H01Q 9/0414; H01Q 7/00; H01Q 1/243; H01Q 19/26; H01Q 9/30
See application file for complete search history.

(56) References Cited

U.S. PATENT DOCUMENTS

2011/0109525 A1 5/2011 Takemura et al.
2015/0123852 A1* 5/2015 Yamagajo ..... H01Q 1/2216 343/700 MS
(Continued)

FOREIGN PATENT DOCUMENTS

CN 104638341 A 5/2015
JP 2011-103630 5/2011
(Continued)

OTHER PUBLICATIONS

International Search Report dated Jul. 4, 2017 in PCT/JP2017/015201 filed Apr. 13, 2017 (with English Translation).
(Continued)

*Primary Examiner* — Hai V Tran
*Assistant Examiner* — Michael M Bouizza
(74) *Attorney, Agent, or Firm* — Oblon, McClelland, Maier & Neustadt, L.L.P.

(57) ABSTRACT

An antenna includes a ground plane; a first resonator connected to a feeding point with reference to the ground plane; and a second resonator that is fed power by the first resonator according to an electromagnetic field coupling with no contact. The second resonator includes a first conductor part, and a second conductor part capacitively-coupled to the first conductor part through a gap. A dielectric loss tangent of a substrate part, on which the second resonator is formed, is greater than zero and less than or equal to 0.01.

20 Claims, 15 Drawing Sheets

(51) Int. Cl.

| | |
|---|---|
| ***H01Q 1/48*** | (2006.01) |
| ***H01Q 9/30*** | (2006.01) |
| ***H01Q 19/26*** | (2006.01) |
| ***H01Q 7/00*** | (2006.01) |
| ***H01Q 1/24*** | (2006.01) |

(52) U.S. Cl.
CPC ..... *H01Q 7/00* (2013.01); *H01Q 9/0414* (2013.01); *H01Q 9/30* (2013.01); *H01Q 19/26* (2013.01)

(56) References Cited

U.S. PATENT DOCUMENTS

| | | | |
|---|---|---|---|
| 2015/0130669 | A1 | 5/2015 | Sonoda et al. |
| 2015/0270614 | A1 | 9/2015 | Kakuya et al. |
| 2018/0062271 | A1 | 3/2018 | Toyao |

FOREIGN PATENT DOCUMENTS

| | | | | |
|---|---|---|---|---|
| JP | 2014-103660 | | | 6/2014 |
| JP | 2014-187720 | | | 10/2014 |
| JP | 5686221 | | | 3/2015 |
| JP | 2015-220738 | | | 12/2015 |
| JP | 2015220738 | A | * | 12/2015 |
| WO | WO 2016/148274 | A1 | | 9/2016 |

OTHER PUBLICATIONS

Written Opinion dated Jul. 4, 2017 in PCT/JP2017/015201 filed Apr. 13, 2017.

* cited by examiner

| MATERIAL OF FILM | SPECIFIC DIELECTRIC CONSTANT | tan δ |
|---|---|---|
| MATERIAL A | 3.4 | 0.034 |
| MATERIAL B | 3.0 | 0.008 |
| MATERIAL C | 2.2 | 0.001 |

ANTENNA

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2017/015201 filed on Apr. 13, 2017 and designating the U.S., which claims priority of Japanese Patent Application No. 2016-081706 filed on Apr. 15, 2016. The entire contents of the foregoing applications are incorporated herein by reference.

BACKGROUND OF THE INVENTION

1. Field of the Invention

The disclosure herein generally relates to an antenna.

2. Description of the Related Art

Conventionally, an antenna including a ground plane; a first resonator connected to a power feeding point with reference to the ground plane; and a second resonator that is fed power by the first resonator according to an electromagnetic field coupling with no contact has been known (See, for example, Japanese Patent No. 5686221).

SUMMARY OF THE INVENTION

Technical Problem

In the aforementioned antenna, a second resonator has a first conductor part and a second conductor part that is capacitively-coupled to the first conductor part through a gap. When a resonance frequency is fixed, a capacitance of the capacitively-coupling part in which the gap is interposed can be increased by narrowing the gap. Thus, the size of the antenna can be reduced. However, a radiation efficiency of the antenna may be degraded as the gap is narrowed.

Then, an aspect of the present invention aims at providing an antenna that is able to be downsized and enhance a radiation efficiency.

Solution to Problem

In order to achieve the aforementioned aim, according to an aspect of the present invention, an antenna including a ground plane; a first resonator connected to a feeding point with reference to the ground plane; and a second resonator that is fed power by the first resonator according to an electromagnetic field coupling with no contact, the second resonator including a first conductor part, and a second conductor part capacitively-coupled to the first conductor part through a gap, and a dielectric loss tangent of a substrate part, on which the second resonator is formed, being greater than zero and less than or equal to 0.01, is provided.

Effect of Invention

According to an aspect of the present invention, because the dielectric loss tangent of the substrate part, in which the second resonator is formed, is greater than 0 and less than or equal to 0.01, even when the gap is narrowed, a radiation efficiency can be enhanced. Thus, an antenna can be downsized and a radiation frequency can be enhanced.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

In the following, with reference to drawings, embodiments for implementing the present invention will be described.

Figure 1:
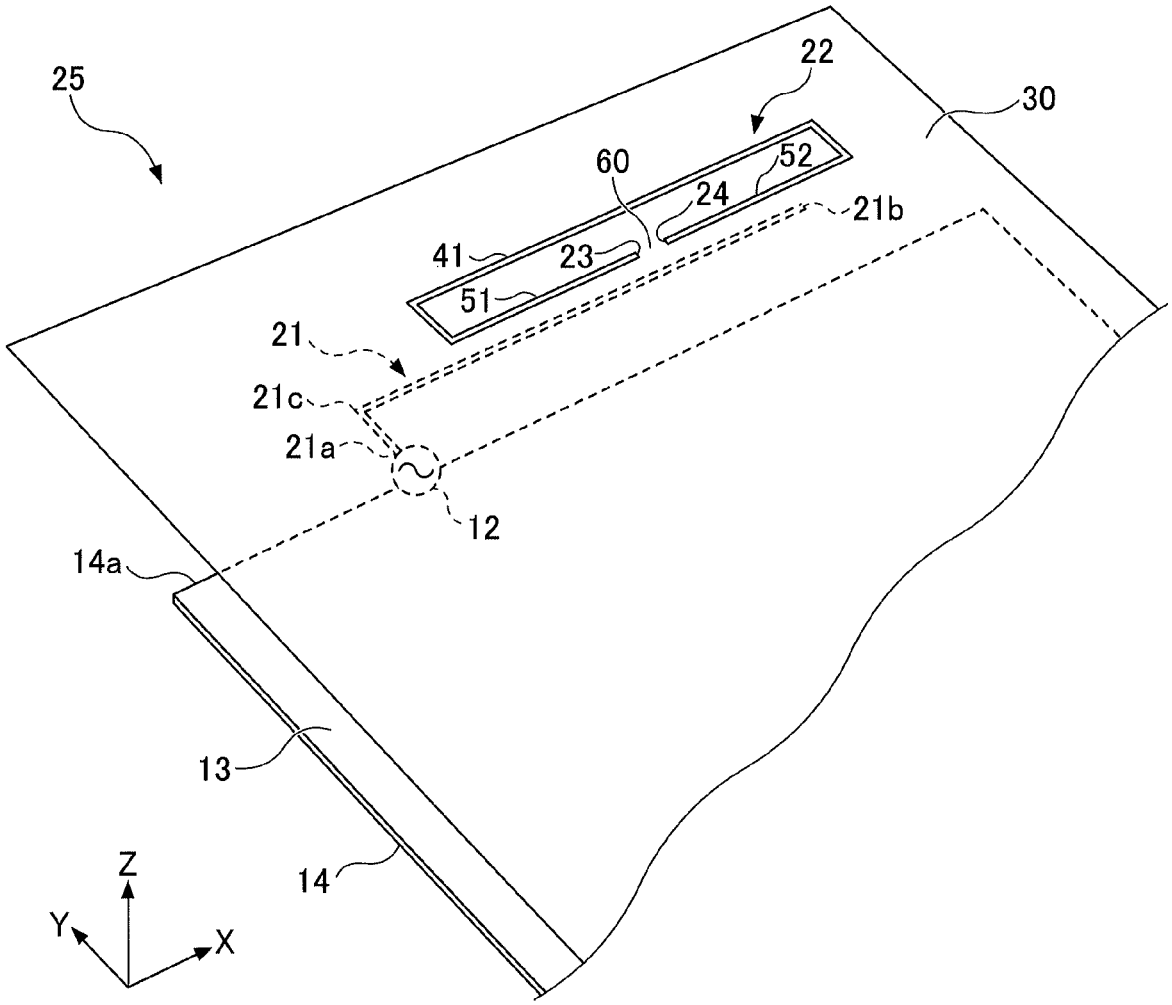
FIG. 1 is a perspective view depicting an example of a configuration of a simulation model of an antenna.

FIG. 1 is a perspective view depicting an example of a configuration of a simulation model of an antenna 25 according to an embodiment. The antenna 25 is mounted on an electronic device. The electronic device performs wireless communication using the antenna 25.

The electronic device on which the antenna 25 is mounted includes, for example, a wireless communication module, a display device itself such as a stationary type television set or a personal computer device, a device mounted on the display device, a mobile body itself, or a device mounted on the mobile body. The mobile body specifically includes, for example, a mobile terminal device that is portable, a vehicle such as a car, and a robot. The mobile terminal device specifically includes, for example, a mobile phone, a smartphone, a computer, a game device, a television device, a music player, a video player, and a wearable device. A specific configuration of the wearable device includes a wristwatch type, a pendant type, and an eyeglasses type.

The antenna 25 accommodates, for example, a wireless communication standard, such as Bluetooth (trademark registered), and a wireless LAN (Local Area Network) standard, such as IEEE 802.11ac. The antenna 25 is connected to a terminal end 12 of a transmission line that uses a ground 14.

The transmission line specifically includes a micro strip line, a strip line, a coplanar wave guide with a ground plane (coplanar wave guide including a ground plane arranged on a surface opposite to a conductor surface, on which a signal line is formed), a coplanar strip line, and the like.

The antenna 25 is provided with a ground 14, a power feeding element 21, and a radiating element 22.

The ground 14 is an example of the ground plane. A ground outer edge portion 14*a* is an example of a linear outer periphery of the ground 14. The ground 14 is, for example, a ground pattern formed on a substrate 13 that is parallel to the XY-plane.

The substrate 13 is a member mainly containing a dielectric. The substrate 13 specifically includes a FR4 (Frame Retardant Type 4) substrate. The substrate 13 may be a flexible substrate that has flexibility. The substrate 13 includes a first substrate surface, and a second substrate surface that is opposite to the first substrate surface. For example, an electronic circuit is implemented on the first substrate surface, and the ground 14 is formed on the second substrate surface. Note that, the ground 14 may be formed on the first substrate surface, or inside the substrate 13.

The electronic circuit implemented on the substrate 13 is, for example, an integrated circuit including at least one of a reception function for receiving signals through the antenna 25 and a transmission function for transmitting signals through the antenna 25. The electronic circuit is realized by an IC chip, for example.

The power feeding element 21 is an example of the first resonator connected to the power feeding point with reference to the ground plane. The power feeding element 21 is connected to the terminal end 12 of the transmission line. The terminal end 12 is an example of the power feeding point with the ground 14 as a ground reference.

The power feeding element 21 may be arranged on the substrate 13, or may be arranged at a position other than the substrate 13. In the case where the power feeding element 21 is arranged on the substrate 13, the power feeding element 21 is, for example, a conductor pattern formed on the first substrate surface of the substrate 13.

The power feeding element 21 extends in a direction away from the ground 14, and is connected to a feeding point (terminal end 12) with the ground 14 as a ground reference. The power feeding element 21 is a linear conductor that is connected to the radiating element 22 contactlessly for high frequency, and can supply power to the radiating element 22. In the drawing, the power feeding element 21 formed in an L shape by a linear conductor extending normally from a ground outer edge portion 14*a*, and a linear conductor extending parallel to the ground outer edge portion 14*a*, is illustrated. For illustration in the drawing, the power feeding element 21, beginning at the terminal end 12, extends from the end portion 21*a*, bends at a bending portion 21*c*, and extends to a tip portion 21*b*. The tip portion 21*b* is an open end to which other conductors are not connected. In the drawing, the power feeding element 21 having the L-shape is illustrated as an example, but the shape of the power feeding element 21 may be another shape such as a linear shape, a meander shape, or a loop shape.

The radiating element 22 is an example of the second resonator in proximity to the first resonator. The radiating element 22 is, for example, arranged apart from the power feeding element 21, and functions as a radiation conductor according to a resonance of the power feeding element 21. The radiating element 22 is, for example, fed power with no contact according to the electromagnetic field coupling to the power feeding element 21, and functions as a radiation conductor. The electromagnetic field coupling means a contactless coupling by electromagnetic waves.

The radiating element 22 includes a conductor part that extends along the ground outer edge portion 14*a*. In the drawing, conductor elements 41, 51 and 52 are illustrated as the conductor parts. The conductor parts are located away from the ground outer edge portion 14*a*. Because the radiating element 22 includes the conductor parts along the ground outer edge portion 14*a*, for example, a directionality of the antenna 25 can be easily controlled.

The power feeding element 21 and the radiating element 22 are arranged, for example, separated away at which electromagnetic field coupling becomes possible with each other. The radiating element 22 includes a power feeding part for receiving power from the power feeding element 21. In the drawing, as the power feeding part, a first conductor element 41 is illustrated. The radiating element 22 contactlessly receives power at the power feeding part through the power feeding element 21 according to the electromagnetic field coupling. By receiving power in this way, the radiating element 22 functions as a radiation conductor of the antenna 25.

By contactlessly receiving power by the power feeding element 21 according to the electromagnetic field coupling, a resonance current (distributed with a stationary wave shape between one tip portion 23 and another tip portion 24), in the same way as in a half-wavelength dipole antenna, flows on the radiating element 22. That is, the radiating element 22 functions as a dipole antenna by contactlessly receiving power by the power feeding element 21 according to the electromagnetic field coupling.

The radiating element 22 includes a first conductor element 41, a second conductor element 51 and a third conductor element 52. The second conductor element 51 is an example of a first conductor part. The third conductor element 52 is an example of a second conductor part.

The first conductor element 41 has one end part connected to the second conductor element 51, and another end part connected to the third conductor element 52. The second conductor element 51 extends in a return direction from the one end part with respect to the first conductor element 41, and the third conductor element 52 extends in a return direction from the another end part with respect to the first conductor element 41.

A first tip portion 23 of the second conductor element 51 and a second tip portion 24 of the third conductor element 52 are separated from each other through a gap 60. That is, a shape of the radiating element 22 is an open loop that opens at the gap 60, and the radiating element 22 is an open loop resonance antenna having the gap 60. The first tip portion 23, which is of the second conductor element 51, is one tip portion of the radiating element 22, and the second tip portion 24, which is of the third conductor element 52, is another tip portion of the radiating element 22.

In the embodiment, the second conductor element 51 and the third conductor element 52 are capacitively coupled with each other through the gap 60. In the case illustrated in FIG. 1, the first tip portion 23 and the second tip portion 24 are capacitively coupled with each other through the gap 60. That is, the radiating element 22 includes a capacitive coupling portion, in which the gap 60 is interposed by the first tip portion 23 and the second tip portion 24.

The first tip portion 23 and the second tip portion 24 are opposite each other in the longitudinal direction of each of the second conductor element 51 and the third conductor element 52. The gap 60 is formed between the first tip portion 23 and the second tip portion 24 in the longitudinal direction.

The radiating element 22 is arranged on a dielectric substrate part 30. The substrate part 30 is, for example, a substrate having a flat surface portion. A part of or a whole of the radiating element 22 may be arranged on a surface of the substrate part 30, or may be arranged inside the substrate part 30.

In the case where a resonance frequency of the radiating element 22 is fixed, the smaller a gap length of the gap 60 is, the capacitance of the capacitive coupling portion, in which the gap 60 is interposed between the second conductor element 51 and the third conductor element 52, becomes greater accordingly. Thus, the size of the radiating element 22 can be reduced. By reducing the size of the radiating element 22, the size of the antenna 25 can be reduced. Although the gap 60 here is formed through a linear configuration, the gap 60 may be formed in a comb-shape interdigital structure.

However, when the gap length of the capacitive coupling portion of the radiating element 22 becomes shorter, a radiation efficiency $\eta$ of the antenna 25 degrades. The radiation efficiency $\eta$ indicates a ratio of radiated power to power supplied to the antenna 25. The degradation of the radiation efficiency $\eta$ arises from a dielectric loss tangent ($\tan\delta$) of the substrate part 30 on which the radiating element 22 is formed.

Then, in the present embodiment, the dielectric loss tangent ($\tan\delta$) of the substrate part 30 is set to be greater than zero, and 0.01 or less. Thus, when the resonance frequency of the radiating element 22 is fixed, even if the gap 60 is reduced, compared with the case where the dielectric loss tangent ($\tan\delta$) is greater than 0.01, the radiation efficiency $\eta$ can be enhanced. Therefore, the size of the antenna 25 can be reduced, and the radiation efficiency $\eta$ can be enhanced.

Moreover, the shortest distance between the power feeding element 21 and the radiating element 22 is preferably greater than zero and less than or equal to $0.117\times\lambda$ for achieving both the reduction of the size of the antenna 25 and the enhancement of the radiation efficiency $\eta$, where $\lambda$ is a wavelength of electromagnetic waves transmitted or received by the antenna 25. The shortest distance is more preferably $0.07\times\lambda$ or less, and further preferably $0.04\times\lambda$ or less.

Figure 2:
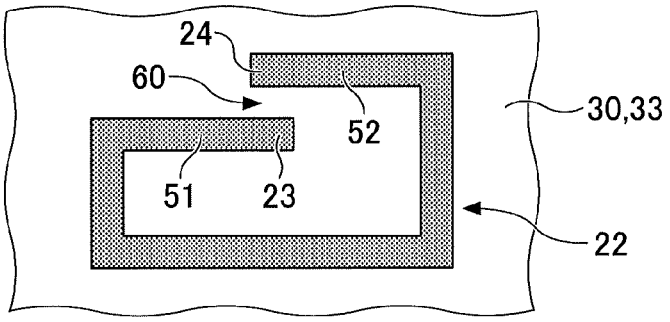
FIG. 2 is a diagram depicting an example of a plane arrangement configuration of a capacitive coupling portion in a planar view of the substrate part.

FIG. 2 is a diagram depicting an example of a plane arrangement configuration of the capacitive coupling portion in a planar view of the substrate part 30, and illustrating from a point of view in a normal direction to a first surface 33 of the substrate part 30. The normal direction to the first surface 33 is parallel to the Z-axis (See FIG. 1). The radiating element 22 and the gap 60 are located on the first surface 33. The first tip portion 23 and the second tip portion 24 are opposite each other in the element width direction of each of the second conductor element 51 and the third conductor element 52. The gap 60 is formed between the first tip portion 23 and the second tip portion 24 in the element width direction.

Figure 3:
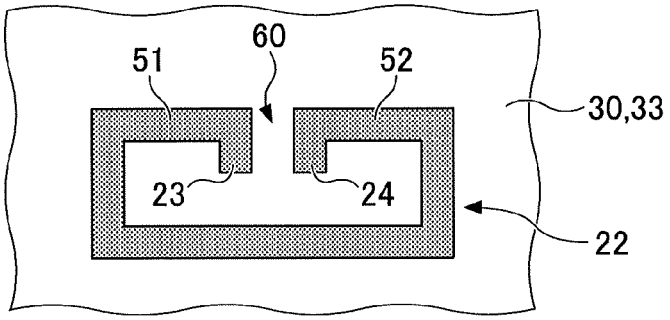
FIG. 3 is a diagram depicting another example of the plane arrangement configuration of the capacitive coupling portion in the planar view of the substrate part.

FIG. 3 is a diagram depicting another example of the plane arrangement configuration of the capacitive coupling portion in the planar view of the substrate part 30, and illustrating from the point of view in the normal direction to the first surface 33 of the substrate part 30. The radiating element 22 and the gap 60 are located on the first surface 33. The first tip portion 23 and the second tip portion 24 are opposite each other in the longitudinal direction of each of the second conductor element 51 and the third conductor element 52. The gap 60 is formed between the first tip portion 23 and the second tip portion 24 in the longitudinal direction. The first tip portion 23 bends in a right angle with respect to the longitudinal direction of the second conductor element 51, and the second tip portion 24 bends in a right angle with respect to the longitudinal direction of the third conductor element 52.

Figure 4:
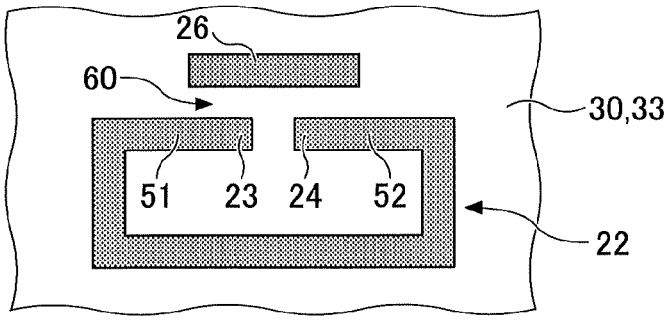
FIG. 4 is a diagram depicting yet another example of the plane arrangement configuration of the capacitive coupling portion in the planar view of the substrate part.

FIG. 4 is a diagram depicting yet another example of the plane arrangement configuration of the capacitive coupling portion in the planar view of the substrate part 30, and illustrating from the point of view in the normal direction to the first surface 33 of the substrate part 30. The radiating element 22 and the gap 60 are located on the first surface 33. The antenna 25 further includes a fourth conductor element 26 located on the first surface 33. The fourth conductor element 26 is an example of a third conductor part. The fourth conductor element 26 is capacitively coupled with the second conductor element 51 and the third conductor element 52 through the gap 60.

The first tip portion 23 and the second tip portion 24 are opposite each other in the longitudinal direction of each of the second conductor element 51 and the third conductor element 52, and are capacitively coupled with each other through a first gap 60. The first gap 60 is formed between the first tip portion 23 and the second tip portion 24 in the longitudinal direction.

The first tip portion 23 of the second conductor element 51 and one tip portion of the fourth conductor element 26 are opposite each other in the element width direction of each of the second conductor element 51 and the fourth conductor element 26, and are capacitively coupled with each other through a second gap 60. The second gap 60 is formed between the first tip portion 23 and the one tip portion of the fourth conductor element 26 in the element width direction.

The second tip portion 24 of the third conductor element 52 and another tip portion of the fourth conductor element 26 are opposite each other in the element width direction of each of the third conductor element 52 and the fourth conductor element 26, and are capacitively coupled with each other through a third gap 60. The third gap 60 is formed between the second tip portion 24 and another tip portion of the fourth conductor element 26 in the element width direction.

According to the configurations, illustrated in FIG. 2 to FIG. 4, because the first tip portion 23 and the second tip portion 24 are in contact with the first surface 33 of the substrate part 30 having a dielectric loss tangent of 0.01 or less, a rate of enhancement of the radiation efficiency η, relative to a reduced length of the gap length of the gap 60, is increased.

FIG. 5 to FIG. 8 are diagrams depicting examples of a lamination arrangement configuration of the capacitive coupling portion. A part denoted by "(a)" in each drawing depicts an example of a cross section cut along a plane parallel to a laminating direction. A part denoted by "(b)" in each drawing depicts an example of a configuration on the first surface 33 side of the substrate part 30. A part denoted by "(c)" in each drawing depicts an example of a configuration on a second surface 34 side of the substrate part 30. The second surface 34 is a surface on the opposite side of the first surface 33.

Figure 5:
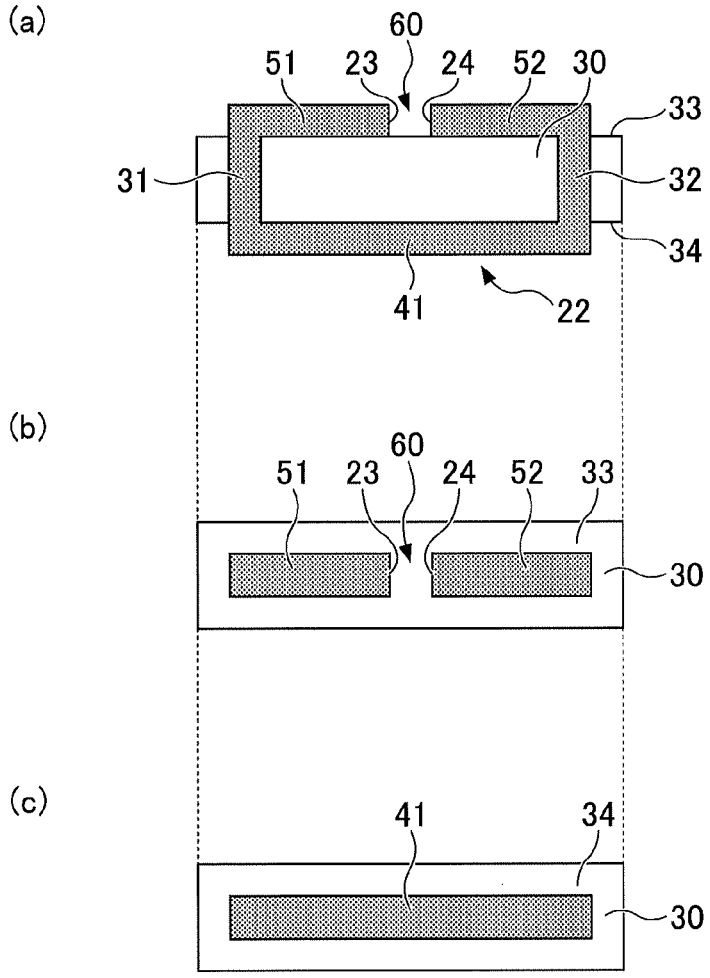
FIG. 5 is a diagram depicting an example of a lamination arrangement configuration of the capacitive coupling portion.

In FIG. 5, the second conductor element 51, the third conductor element 52 and the gap 60 are located on the first surface. The first conductor element 41 is located on the second surface 34. The first tip portion 23 and the second tip portion 24 are opposite each other in the longitudinal direction of each of the second conductor element 51 and the third conductor element 52. The gap 60 is formed between the first tip portion 23 and the second tip portion 24 in the longitudinal direction.

The first conductor element 41 includes one end part connected to a first outer end portion of the second conductor element 51 through a first via 31, and another end part connected to a second outer end portion of the third conductor element 52 through a second via 32. The first via 31 and the second via 32 penetrate through the substrate part 30.

According to the configuration illustrated in FIG. 5, because the first tip portion 23 and the second tip portion 24 are in contact with the first surface 33 of the substrate part 30 having the dielectric loss tangent of 0.01 or less, a rate of enhancement of the radiation efficiency η, relative to a reduced length of the gap length of the gap 60, is increased.

Figure 6:
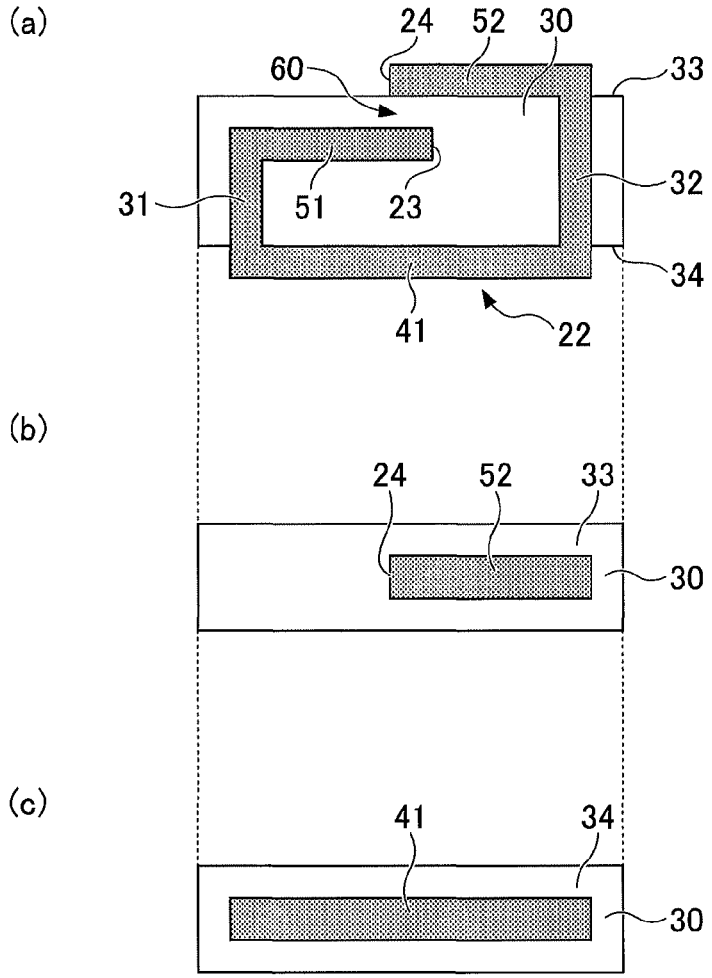
FIG. 6 is a diagram depicting another example of the lamination arrangement configuration of the capacitive coupling portion.

In FIG. 6, the third conductor element 52 is located on the first surface 33. The second conductor element 51 and the gap 60 are located inside the substrate part 30. The first conductor element 41 is located on the second surface 34. The first tip portion 23 and the second tip portion 24 are opposite each other in the element width direction of each of the second conductor element 51 and the third conductor element 52. The gap 60 is formed between the first tip portion 23 and the second tip portion 24 in the element width direction.

Figure 7:
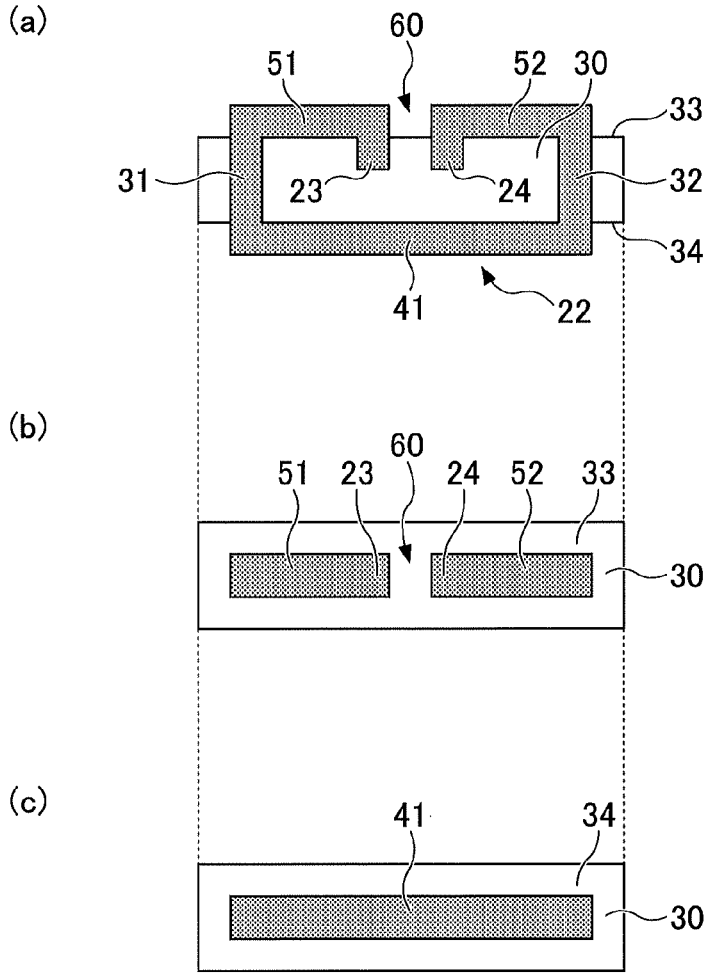
FIG. 7 is a diagram depicting yet another example of the lamination arrangement configuration of the capacitive coupling portion.

In FIG. 7, the first tip portion 23 bends in a right angle with respect to the longitudinal direction of the second conductor element 51, and the second tip portion 24 bends in a right angle with respect to the longitudinal direction of the third conductor element 52. The gap 60 includes a portion located on the first surface 33, and a portion located inside the substrate part 30.

Figure 8:
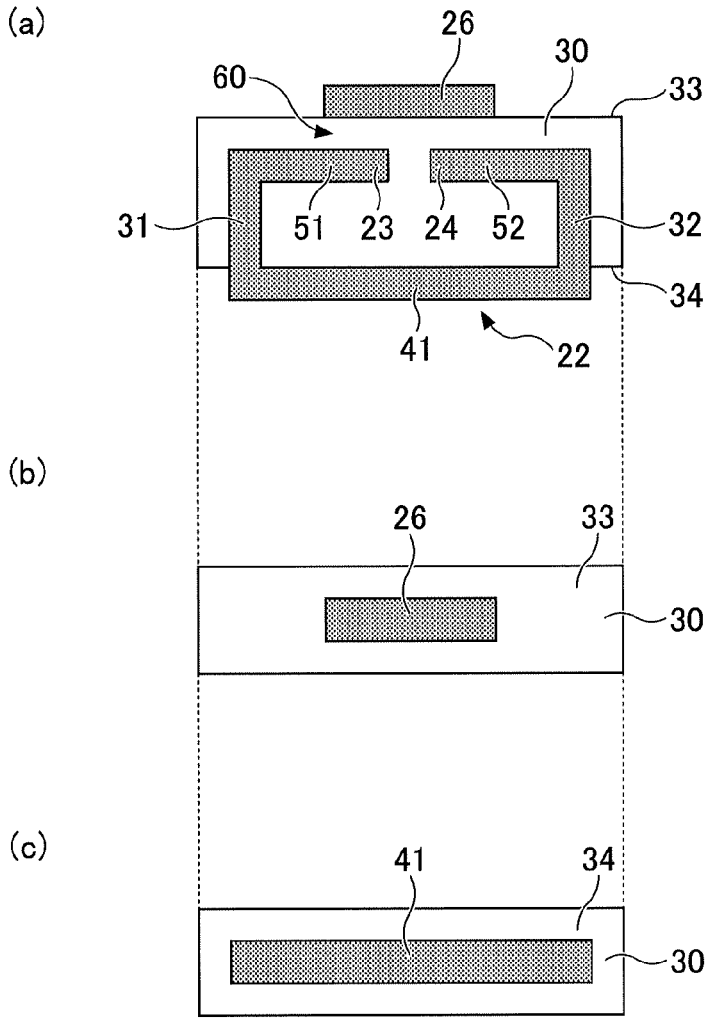
FIG. 8 is a diagram depicting still another example of the lamination arrangement configuration of the capacitive coupling portion.

In FIG. 8, the fourth conductor element 26 is capacitively coupled with the second conductor element 51 and the third conductor element 52 through the gap 60. In the same way as in the case illustrated in FIG. 4, three gaps 60 are formed. The respective gaps 60 are located inside the substrate part 30.

According to the configurations illustrated in FIG. 6 to FIG. 8, because the gap 60 is located inside the substrate part 30 (the dielectric loss tangent is 0.01 or less), a rate of enhancement of the radiation efficiency η, relative to a reduced length of the gap length of the gap 60, is increased.

Figure 9:
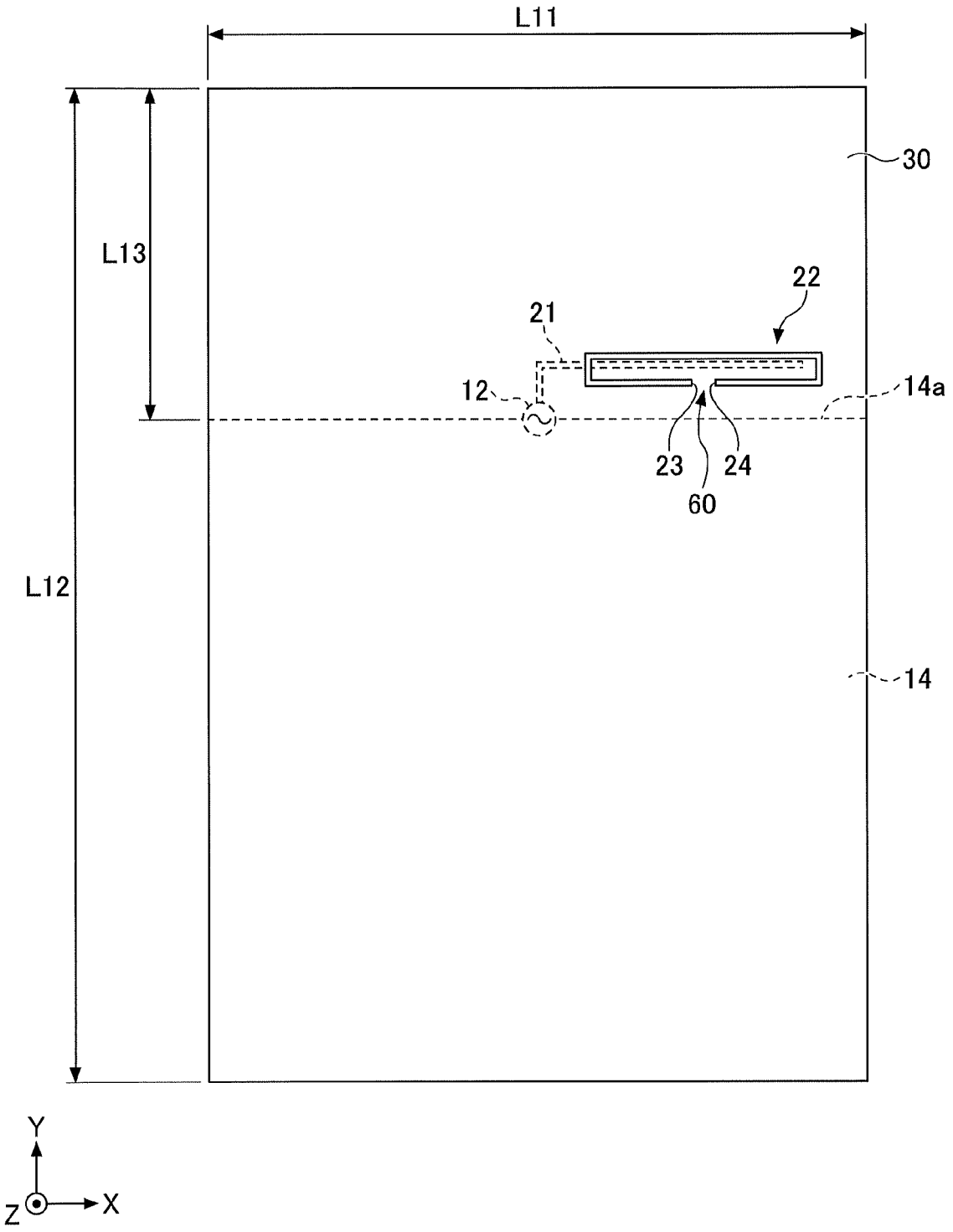
FIG. 9 is a diagram depicting an example of a configuration of the antenna when a simulation is performed in a planar view.
Figure 10:
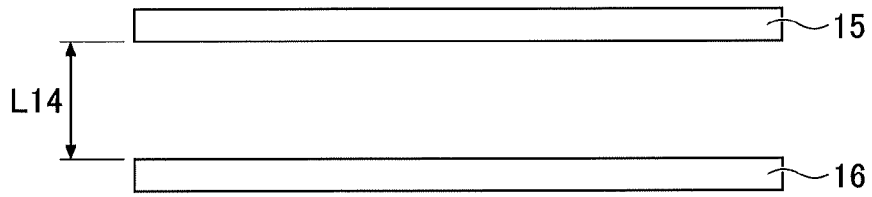
FIG. 10 is a diagram depicting an example of a lamination configuration of the antenna when the simulation is performed.
Figure 11:
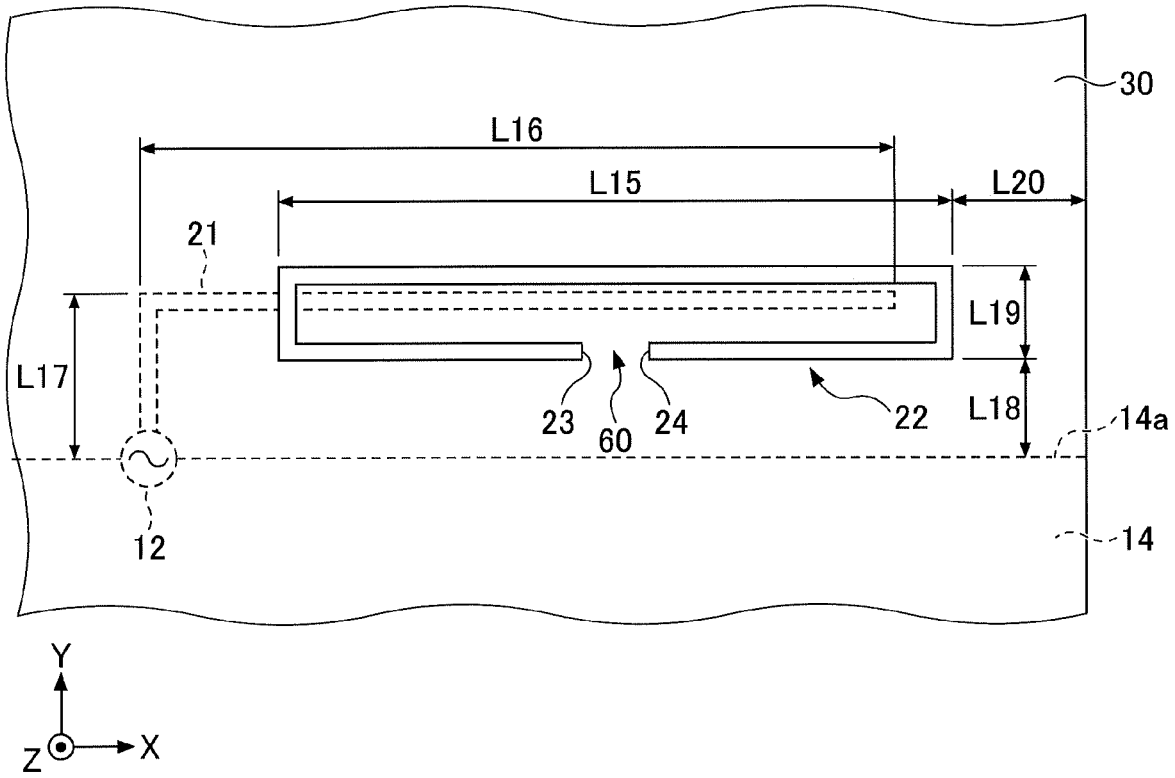
FIG. 11 is a diagram depicting an example of a configuration of a radiating element and a power feeding element when the simulation is performed.

FIG. 9 is a diagram depicting an example of a configuration of the antenna 25 when a simulation is performed in a planar view. FIG. 10 is a diagram depicting an example of a lamination configuration of the antenna 25 when the simulation is performed. The power feeding element 21 and the ground 14 are arranged in a power feeding element layer 16, and the radiating element 22 and the substrate part 30 are arranged in a radiating element layer 15. FIG. 11 is a diagram depicting an example of a configuration of the radiating element 22 and the power feeding element 21 when the simulation is performed.

In FIG. 9 to FIG. 11, respective dimensions when the simulation is performed are as follows (in units of mm), L11: 40,
L12: 60,
L13: 20,
L14: 2,
L15: 14,
L16: 15.5,
L17: 2.5,
L18: 1.9,
L19: 1.7, and
L20: 2.9.

Figure 12:
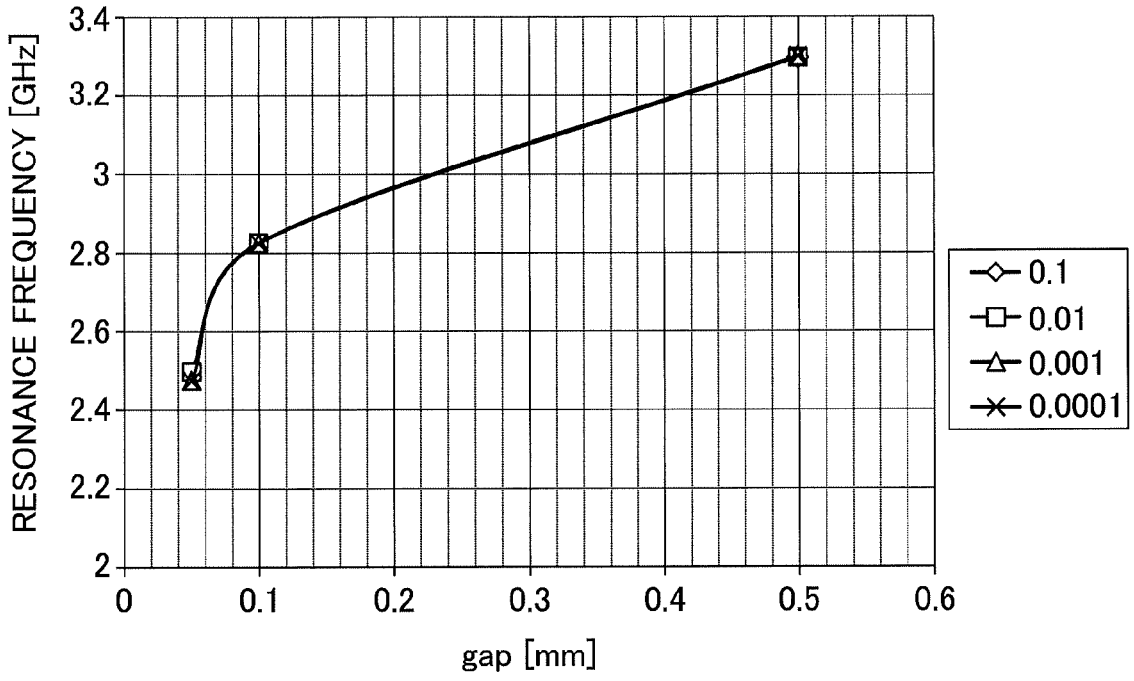
FIG. 12 is a diagram depicting an example of a relation between a gap length of the capacitive coupling portion and a resonance frequency.

FIG. 12 is a diagram depicting an example of a relation between a gap length of the capacitive coupling portion and a resonance frequency, for different values of the dielectric loss tangent (tan δ) of the substrate part 30. The horizontal axis "gap" indicates a gap length of the gap 60 between the first tip portion 23 and the second tip portion 24. The vertical axis "resonance frequency" indicates a resonance frequency of the antenna 25. As shown in FIG. 12, even if the dielectric loss tangent is changed from 0.0001 to 0.1, for the same gap length, the resonance frequency is almost unchanged.

Figure 13:
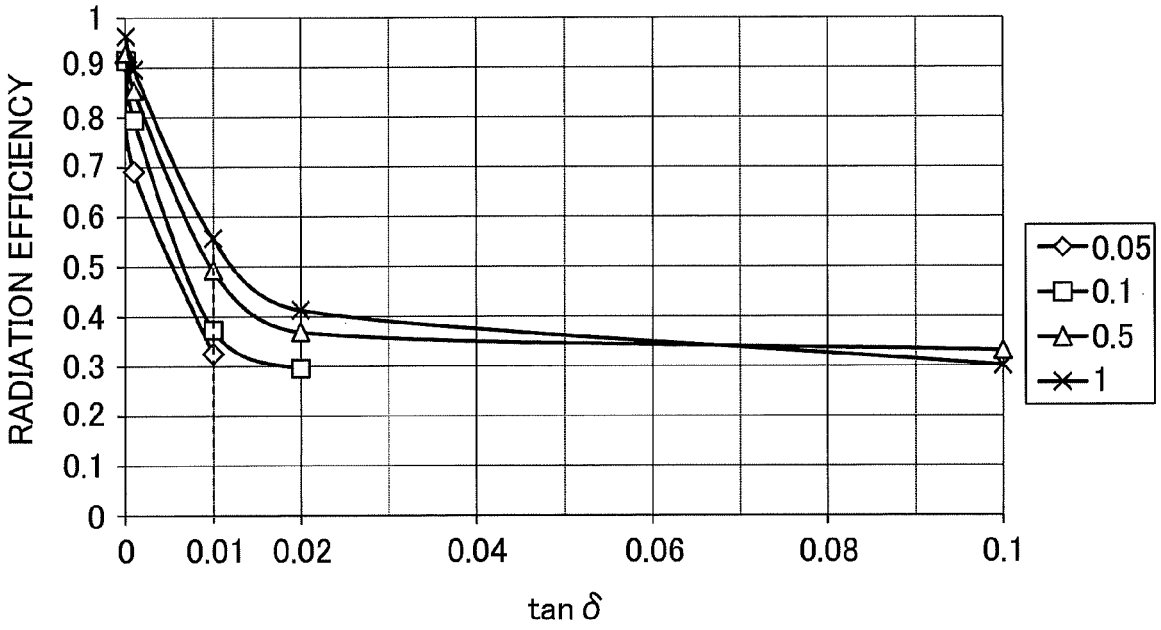
FIG. 13 is a diagram depicting an example of a relation between a dielectric loss tangent and a radiation efficiency.

FIG. 13 is a diagram depicting an example of a relation between a dielectric loss tangent and the radiation efficiency η, for different values of a gap length of the gap 60. FIG. 13 shows four cases with the gap lengths of 0.05 mm, 0.1 mm, 0.5 mm and 1 mm.

In FIG. 13, for the cases with the gap lengths of 0.05 mm and 0.1 mm, a region in which plots are missing represents a region where the antenna 25 does not function as an antenna.

As shown in FIG. 13, when the dielectric loss tangent (tan δ) of the substrate part 30 is greater than zero and less than or equal to 0.01, even when the gap 60 is narrowed, the radiation efficiency η is enhanced, compared with the case where the dielectric loss tangent is greater than 0.01. Thus, both the reduction of the size of the antenna 25 and the enhancement of the radiation efficiency η are achieved.

Figure 14:
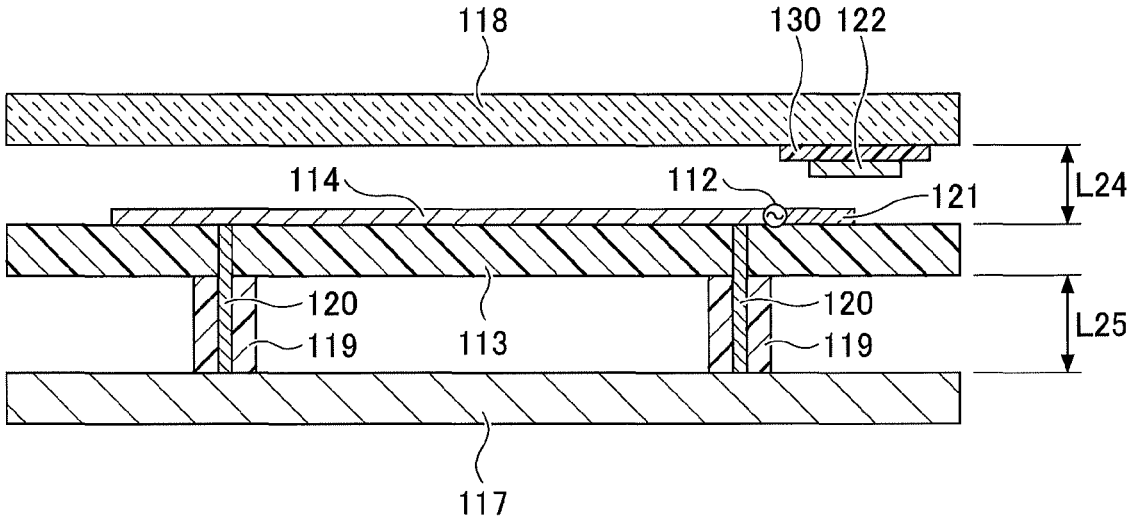
FIG. 14 is a cross-sectional view schematically depicting an example of a configuration of an antenna mounted on an actual prototype of an electronic device.

FIG. 14 is a cross-sectional view schematically depicting an example of a configuration of the antenna 25 mounted on an actual prototype of an electronic device. A ground 114 is a schematic example of the ground 14, a power feeding element 121 is a schematic example of the power feeding element 21, and a radiating element 122 is a schematic example of the radiating element 22. A substrate 113 is an FR4 substrate that is a schematic example of the substrate 13. A terminal end 112 is a schematic example of the terminal end 12 (power feeding point). A film 130 is a schematic example of the substrate part 30 where the dielectric loss tangent is greater than zero and less than or equal to 0.01.

The radiating element 122 is mounted on an inner surface of a glass plate 118 through the film 130. The glass plate 118 is a back cover of an electronic device. The substrate 113 is mounted on a metallic chassis 117 of the electronic device by at least one mounting member 119. The ground 114 is grounded to the chassis 117 through at least one connection part 120.

Figure 15:
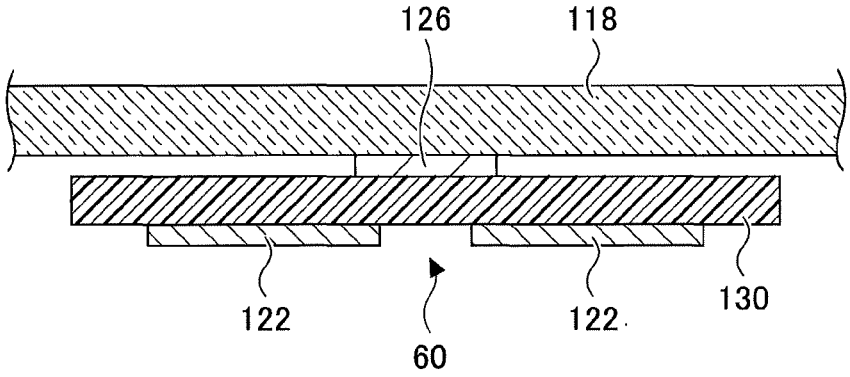
FIG. 15 is a cross-sectional view schematically depicting a peripheral part of the radiating element in the antenna illustrated in FIG. 14.

FIG. 15 is a cross-sectional view schematically depicting a peripheral part of the radiating element 122 in the antenna 25, illustrated in FIG. 14. The radiating element 122 is an open loop resonance antenna having the gap 60. A conductor strip 126 is a schematic example of the aforementioned fourth conductor element 26. In FIG. 14, illustration of the conductor strip 126 is omitted. The conductor strip 126 is arranged opposite to the gap 60 through the film 130, so as to be capacitively coupled with conductor elements on both sides of the gap 60, that form the gap 60. That is, the open loop resonance antenna (radiating element 122) has a structure in which the open resonance antenna can be capacitively coupled with the conductor strip 126 in a direction normal to the film 130. According to the aforementioned configuration, because a gap part of an open loop (gap 60) does not directly face the glass plate 118, the radiation efficiency can be prevented from being degraded due to the dielectric loss tangent of the glass plate 118. The conductor strip 126 is arranged between an inner surface of the glass plate 118 and the film 130, and is in contact with both the inner surface of the glass plate 118 and the film 130.

In order to control an influence from the glass plate 118 with the dielectric loss tangent that is lower than that of the film 130, the radiating element 122 is located on the surface of the film 130 opposite to the glass plate 118, so as to be separated from the glass plate 118.

Figure 16:
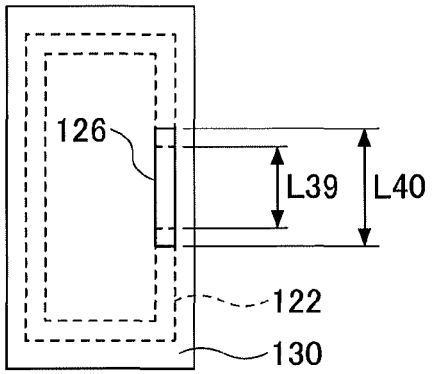
FIG. 16 is a planar view depicting the part illustrated in FIG. 15, viewed from a conductor strip to a film.

FIG. 16 is a planar view depicting a part illustrated in FIG. 15, viewed from the conductor strip 126 to the film 130. In FIG. 16, an illustration of the glass plate 118 is omitted. Both end portions of the conductor strip 126 are opposite to the conductor elements on both sides of the gap 60 that form the gap 60 through the film 130.

Figure 17:
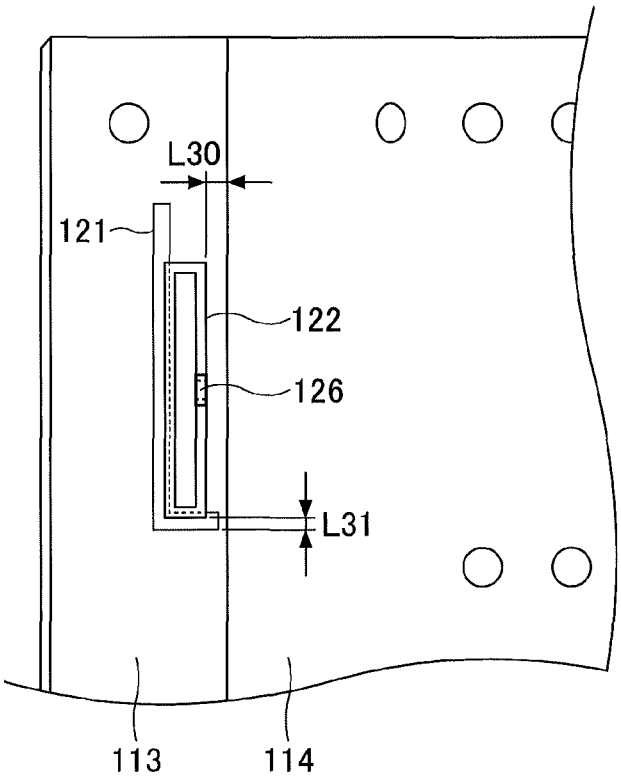
FIG. 17 is a diagram depicting an example of the configuration of the antenna illustrated in FIG. 14 in a planar view.
Figure 18:
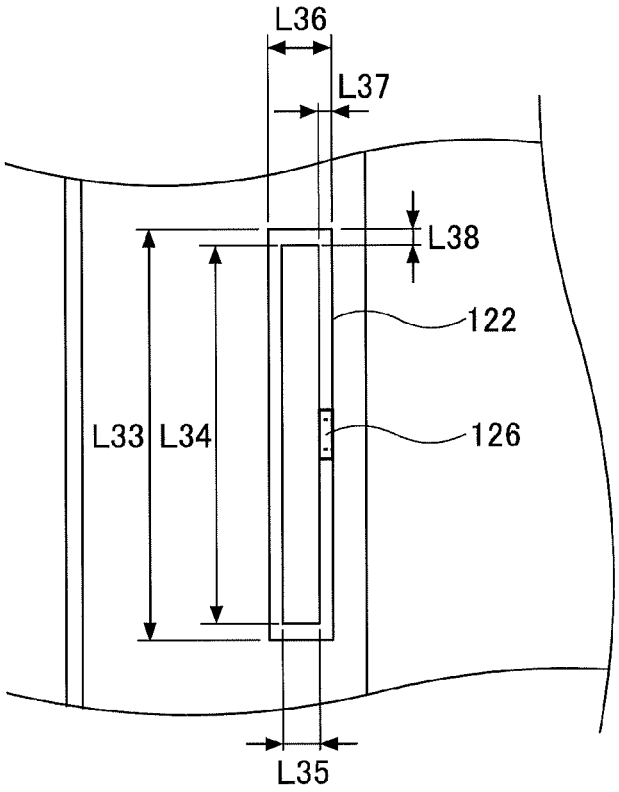
FIG. 18 is a diagram depicting an example of the configuration of the radiating element and the conductor strip of the antenna, illustrated in FIG. 17, in a planar view.
Figure 19:
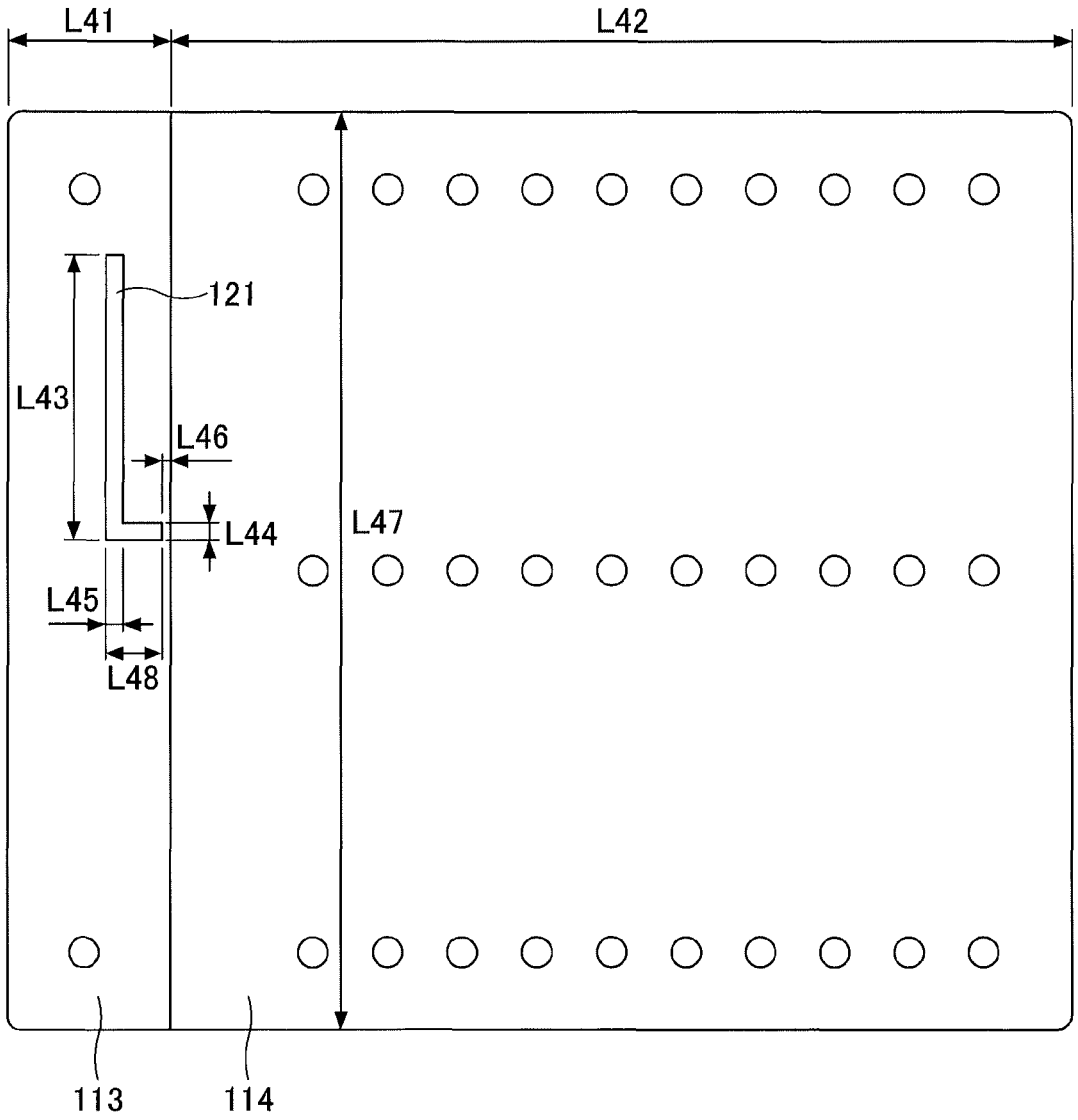
FIG. 19 is a diagram depicting an example of the configuration of the power feeding element of the antenna, illustrated in FIG. 17, in a planar view.

FIG. 17 is a diagram depicting an example of the configuration of the antenna 25 illustrated in FIG. 14 in a planar view. FIG. 18 is a diagram depicting an example of the configuration of the radiating element 122 and the conductor strip 126 of the antenna 25, illustrated in FIG. 17, in a planar view. FIG. 19 is a diagram depicting an example of the configuration of the power feeding element 121 of the antenna 25, illustrated in FIG. 17, in a planar view.

Figures 20, 21:
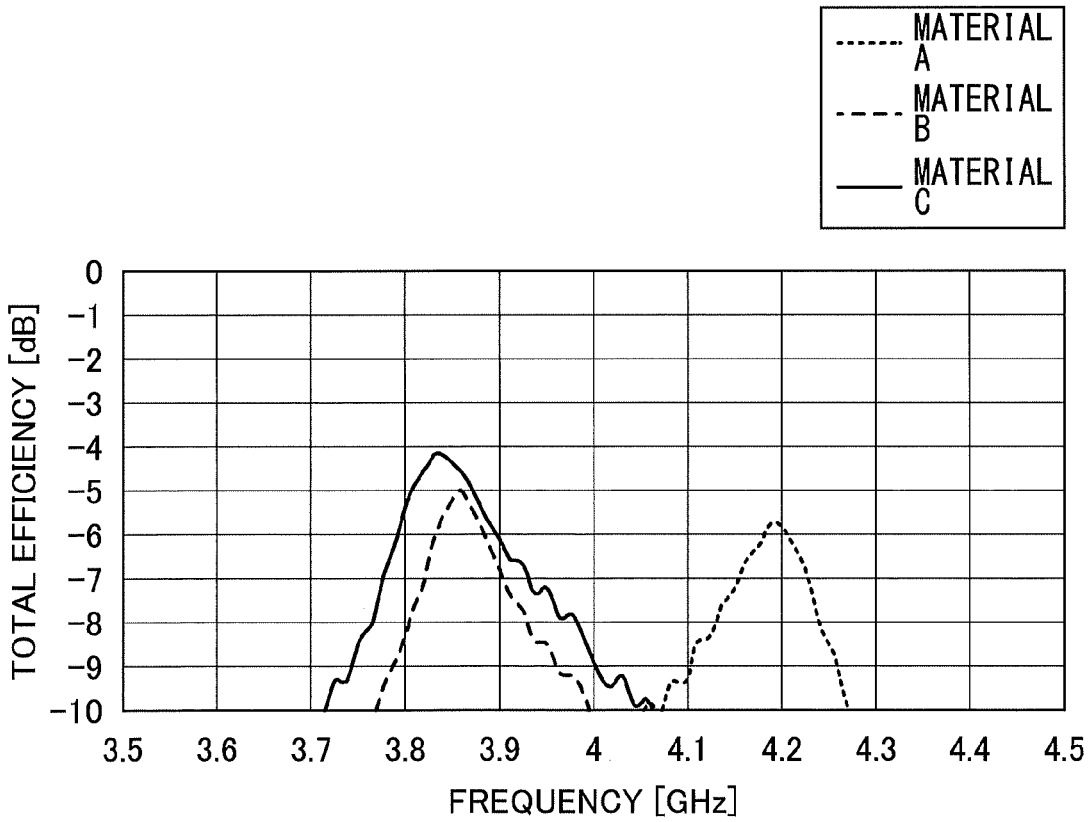
FIG. 20 is a table showing specific dielectric constants and dielectric loss tangents of respective materials.
FIG. 21 is a diagram showing an example of results of an actual measurement of a total efficiency depending on a material of the film.
Figure 22:
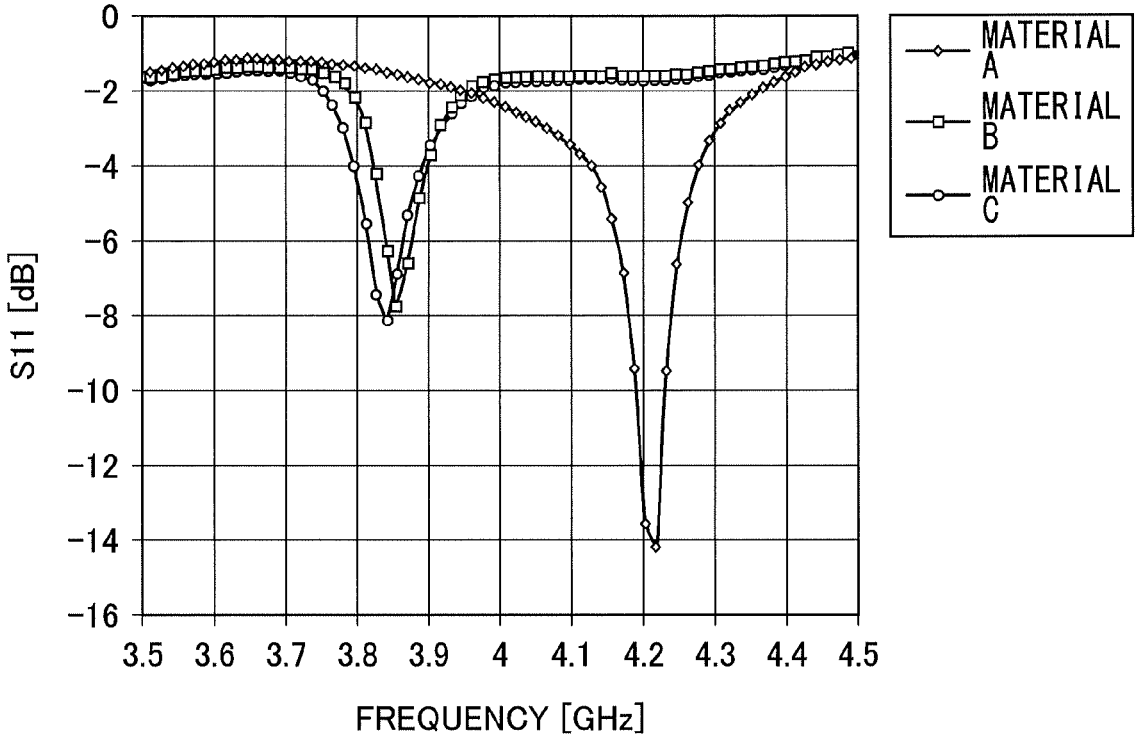
FIG. 22 is a diagram showing an example of results of an actual measurement of a reflection coefficient depending on the material of the film.

FIG. 20 is a table showing specific dielectric constants and dielectric loss tangents (tan δ) of the respective materials. FIG. 21 is a diagram showing an example of results of an actual measurement of a total efficiency depending on the material of the film 130. FIG. 22 is a diagram showing an example of results of an actual measurement of a reflection coefficient S11 depending on the material of the film 130. The total efficiency indicates a product of the radiation efficiency η and the reflection coefficient S11. That is, the total efficiency indicates a radiation efficiency with consideration of the return loss of the antenna 25 is added.

As illustrated in FIG. 22, when the material is "B" or "C", in which the dielectric loss tangent is 0.01 or less, for the film 130, an excellent impedance matching can be obtained at a desired resonance frequency. Moreover, as illustrated in FIG. 21, regarding the total efficiency, the material "B" with the dielectric loss tangent of 0.008 is more excellent than the material "A", and the material "C" with the dielectric loss tangent of 0.001 is more excellent than the material "B".

Note that when the total efficiency and the reflection coefficient were measured in FIG. 21 and FIG. 22, the respective dimensions of the respective parts, illustrated in FIG. 14 to FIG. 19 were as follows (in units of mm), L24: 2.3,
L25: 3.9,
L39: 1,
L40: 1.5,
L30: 1.3,
L31: 1.3,
L35: 1.2,
L36: 2,
L37: 0.4,
L38: 0.4,
L33: 14.4,
L34: 13.6,
L41: 10.5
L42: 59.5,
L43: 18.5,
L44: 1,
L45: 1,
L46: 0.5,
L47: 60, and
L48: 3.5.

Moreover, a thickness of the film 130 was 50 μm.

Figure 23:
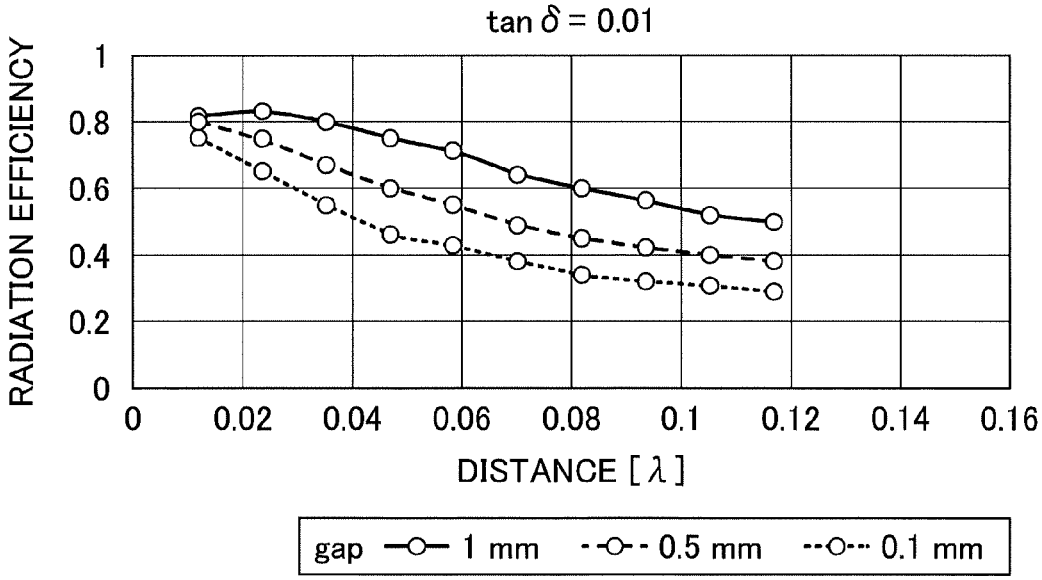
FIG. 23 is a diagram showing an example of results of calculation by simulation for a relation between the radiation efficiency and a distance between the power feeding element and the radiating element.

FIG. 23 is a diagram showing an example of results of calculation by simulation for a relation between the radiation efficiency and a distance between the power feeding element 21 and the radiating element 22, in the configuration of the antenna 25, illustrated in FIG. 9 to FIG. 11. FIG. 23 shows the results in the case where the dielectric loss tangent (tan δ) is 0.01. The horizontal axis indicates the shortest distance D between the power feeding element 21 and the radiating element 22. The vertical axis indicates the radiation efficiency η. The value denoted by "gap" indicates a gap length of the gap 60 between the first tip portion 23 and the second tip portion 24. A wavelength of electromagnetic waves transmitted or received by the antenna 25 is denoted by λ.

As shown in FIG. 23, in the case where the shortest distance D is 0.117×λ, when the gap length is 1 mm, the radiation efficiency η is 50% or more. When the gap length is 0.5 mm or 0.1 mm, the radiation efficiency η is less than 50%. However, by changing the dielectric loss tangent (tan δ) to a value less than 0.01, the radiation efficiency can be made greater than or equal to 50%.

Moreover, as long as the shortest distance D is 0.07×λ or less, even if "the dielectric loss tangent (tan δ) is 0.01 and the gap length is 0.5 mm", the radiation efficiency η can be made 50% or more. Moreover, when the shortest distance D is 0.04×λ or less, even if "the dielectric loss tangent (tan δ) is 0.01 and the gap length is 0.5 mm", the radiation efficiency η can be made 50% or more.

Note that in FIG. 23, dimensions of the respective parts when the simulation was performed were the same as the aforementioned values when the simulation was performed for the configurations illustrated in FIG. 9 to FIG. 11.

As described above, the antenna has been described by the embodiments. The present invention is not limited to the embodiments. Various variations and enhancements, such as combination/replacement with/by a part or a whole of another embodiment may be made without departing from the scope of the present invention.

REFERENCE SIGNS LIST

12 terminal end
14 ground
21 power feeding element
22 radiating element
23 first tip portion
24 second tip portion
25 antenna
26 fourth conductor element
30 substrate part
41 first conductor element
51 second conductor element
52 third conductor element
60 gap

What is claimed is:

1. An antenna, comprising: a substrate part;

a substrate having a ground plane;

a first resonator connected to a feeding point with reference to the ground plane; and a second resonator formed on the substrate part such that the second resonator is not in contact with the first resonator and that the first resonator feeds power to the second resonator by an electromagnetic field coupling, wherein the second resonator includes a first conductor part, and a second conductor part separated from the first conductor part by a gap and capacitively-coupled to the first conductor part through the gap, the first and second conductor parts have the gap formed inside the substrate part, and the substrate part has a dielectric loss tangent of greater than zero and less than or equal to 0.01 and the second resonator is formed such that when a length of the gap is set to be 0.05 mm, a radiation efficiency $\eta$ of the antenna is 0.3 or greater.

2. An antenna, comprising: a substrate part:

a substrate having a ground plane;

a first resonator connected to a feeding point with reference to the ground plane; and a second resonator formed on the substrate part such that the second resonator is not in contact with the first resonator and that the first resonator feeds power to the second resonator by an electromagnetic field coupling, wherein the second resonator includes a first conductor part, and a second conductor part separated from the first conductor part by a gap and capacitively-coupled to the first conductor part through the gap, the first and second conductor parts have the gap formed inside the substrate part, the substrate part has a dielectric loss tangent of greater than zero and less than or equal to 0.01 and the second resonator is formed such that when a length of the gap is set to be 0.05 mm, a radiation efficiency $\eta$ of the antenna is 0.3 or greater, and a shortest distance between the first resonator and the second resonator is greater than zero and less than or equal to $0.117\times\lambda$, where $\lambda$ is a wavelength of an electromagnetic wave transmitted or received by the second resonator.

3. The antenna according to claim 1, wherein the second resonator has an open loop shape such that the first conductor part includes one tip portion of the second resonator, and that the second conductor part includes another tip portion of the second resonator.

4. The antenna according to claim 1, wherein the first and second conductor parts have the gap formed such that the gap extends to a surface of the substrate part.

5. The antenna according to claim 1, further comprising:

a third conductor part formed on a surface of the substrate part such that the third conductor part is separated from the first conductor part and the second conductor part by a second gap and capacitively coupled with the first conductor part and the second conductor part through the second gap.

6. The antenna according to claim 1, wherein the second resonator is formed such that the length of the gap between the first and second conductor parts is 0.05 mm or greater.

7. The antenna according to claim 1, wherein the second resonator is formed such that the length of the gap between the first and second conductor parts is in a range of 0.05 mm to 1 mm.

8. The antenna according to claim 2, wherein the second resonator has an open loop shape such that the first conductor part includes one tip portion of the second resonator, and that the second conductor part includes another tip portion of the second resonator.

9. The antenna according to claim 2, wherein the first and second conductor parts have the gap formed such that the gap extends to a surface of the substrate part.

10. The antenna according to claim 2, further comprising:

a third conductor part formed on a surface of the substrate part such that the third conductor part is separated from the first conductor part and the second conductor part by a second gap and capacitively coupled with the first conductor part and the second conductor part through the second gap.

11. The antenna according to claim 2, wherein the second resonator is formed such that the length of the gap between the first and second conductor parts is 0.05 mm or greater.

12. The antenna according to claim 2, wherein the second resonator is formed such that the length of the gap between the first and second conductor parts is in a range of 0.05 mm to 1 mm.

13. The antenna according to claim 1, wherein the first resonator comprises a conductor pattern formed on a surface of the substrate, and the ground plane is a ground pattern formed on the surface of the substrate.

14. The antenna according to claim 2, wherein the first resonator comprises a conductor pattern formed on a surface of the substrate, and the ground plane is a ground pattern formed on the surface of the substrate.

15. The antenna according to claim 1, wherein the second resonator has an open loop shape such that the first conductor part includes one tip portion of the second resonator on a surface of the substrate part, and that the second conductor part includes another tip portion of the second resonator inside the substrate part.

16. The antenna according to claim 15, wherein the second resonator is formed such that the length of the gap between the first and second conductor parts is 0.05 mm or greater.

17. The antenna according to claim 15, wherein the second resonator is formed such that the length of the gap between the first and second conductor parts is in a range of 0.05 mm to 1 mm.

18. The antenna according to claim 15, wherein the first resonator comprises a conductor pattern formed on a surface of the substrate, and the ground plane is a ground pattern formed on the surface of the substrate.

19. The antenna according to claim 2, wherein the second resonator has an open loop shape such that the first conductor part includes one tip portion of the second resonator inside the substrate part, and that the second conductor part includes another tip portion of the second resonator inside the substrate part.

20. The antenna according to claim 19, wherein the second resonator is formed such that the length of the gap between the first and second conductor parts is 0.05 mm or greater.

* * * * *